US008764502B2

(12) United States Patent
McCredie et al.

(10) Patent No.: US 8,764,502 B2
(45) Date of Patent: Jul. 1, 2014

(54) FIN DEVICES

(75) Inventors: Don McCredie, Warriewood (AU); Martin Peknice, Palm Beach (AU); Michael John Hort, Chatswood (AU)

(73) Assignee: Surf Hardware International Pty Ltd., Mona Vale, NSW (AU)

( * ) Notice: Subject to any disclaimer, the term of this patent is extended or adjusted under 35 U.S.C. 154(b) by 154 days.

(21) Appl. No.: 13/138,839

(22) PCT Filed: Apr. 9, 2010

(86) PCT No.: PCT/AU2010/000399

§ 371 (c)(1),
(2), (4) Date: Jan. 10, 2012

(87) PCT Pub. No.: WO2010/115242

PCT Pub. Date: Oct. 14, 2010

(65) Prior Publication Data

US 2012/0100767 A1 Apr. 26, 2012

(30) Foreign Application Priority Data

Apr. 9, 2009 (AU) ..... 2009901546
Jul. 31, 2009 (AU) ..... 2009903565

(51) Int. Cl.
*B63B 35/79* (2006.01)

(52) U.S. Cl.
USPC ..... 441/79

(58) Field of Classification Search
USPC ..... 441/65, 74, 79
See application file for complete search history.

(56) References Cited

U.S. PATENT DOCUMENTS

| | | | | |
|---|---|---|---|---|
| 5,176,553 | A | 1/1993 | Tuttle | |
| 6,068,531 | A * | 5/2000 | Patterson | 441/79 |
| 6,896,570 | B1 | 5/2005 | O'Keefe et al. | |
| 6,918,806 | B2 | 7/2005 | Skedeleski | |
| 6,935,910 | B2 * | 8/2005 | Laine | 441/79 |

FOREIGN PATENT DOCUMENTS

| | | |
|---|---|---|
| DE | 4 038 517 | 6/1991 |
| EP | 0 079 113 | 5/1983 |
| WO | WO 92/19492 | 11/1992 |
| WO | WO 2005/105566 | 11/2005 |
| WO | WO 2010/115242 | 10/2010 |

OTHER PUBLICATIONS

International Search Report PCT/AU2010/000399 dated Jul. 16, 2010.
International Preliminary Report on Patentability PCT/AU2010/000399 dated Feb. 18, 2011.
International Search Report and Written Opinion PCT/AU2010/000399 dated Jul. 22, 2010.

* cited by examiner

*Primary Examiner* — Lars A Olson
(74) *Attorney, Agent, or Firm* — TraskBritt, P.C.

(57) ABSTRACT

A fin module for a surfboard having a bore extending through the core between the top deck and the underside, including: a fin comprising a core and extending base portion, and a cover forming a fin blade made of resilient material; and a fin box having a cavity for receiving the base portion and adapted to receive an engagement end of a connector having a head anchorable at the top deck and an elongate member extendable through the core of the surfboard to pull the fin box toward the connector head.

19 Claims, 10 Drawing Sheets

FIN DEVICES

CROSS-REFERENCE TO RELATED APPLICATIONS

This is a national phase entry under 35 U.S.C. §371 of international Patent Application PCT/AU2010/000399, filed Apr. 9, 2010, published in English as International Patent Publication WO 2010/115242 A1 on Oct. 14, 2010, which claims benefit under Article 8 of the Patent Cooperation Treaty to Australian Patent Application Serial No. AU2009901546, filed Apr. 9, 2009, and to Australian Patent Application Serial No. AU2009903565, filed Jul. 31, 2009.

TECHNICAL FIELD

This invention relates to fin devices, including a fin attachment, box, set, module and/or system for a surfboard. More particularly, the invention relates to a fin module suitable for a softboard.

BACKGROUND OF THE INVENTION

The following references to and descriptions of prior proposals or products are not intended to be and are not to be construed as statements or admissions of common general knowledge in the art. In particular, the following prior art discussion does not relate to what is commonly or well known by a person skilled in the art, but assists in the understanding of the inventive step of the present invention of which the identification of pertinent prior art proposals is but one part.

The softboard category of surfboards is gaining in popularity because it can assist learners and may be used in some general swimming areas from which traditional surfboards are often banned. A softboard will generally have a core of foam (e.g., polyurethane, EVA, EPS), sometimes multi-layered, and an outer skin of polyethylene, for example, on the deck and rails, giving a softer surface for skin contact and helping to avoid contact injuries.

Generally, it is desirable for a softboard to have a fin or fins that are made of softer material than those for traditional surfboards. Some softboard fins are made of polyvinylchloride (PVC) or thermo plastic polyurethane (TPU) and generally are made in a single piece including the fin blade and a fixing tab at the fin's base. The fin blade and the fixing tab, so integrally formed, are made from the same resilient and relatively soft material. More traditional surfboards are typically made of fibreglass/foam laminate and the fin fixing elements may typically comprise a pair of counter sunk bosses sitting flush with the deck of the board. The fin base may have tabs adapted to be received in corresponding slots in the bosses and the fin is secured in place by a screw or screws. In contrast, because the core of a softboard is relatively soft, it cannot withstand pulling forces. As a consequence, a fin system for a softboard must go from one side of the board through to the other and be attached using broad-headed polyamide screws with the screw heads sitting on or flush with the deck of the board.

To date, traditional softboard fins have been very hard to install. This is problematical for retailers. Softboards are transported from the manufacturer with the fins and screws detached from the boards to minimise transport volumes and, in most situations, the retailer is expected to attach the fins before sale and delivery of the softboard to the customer. As described above, the fin and the tab unit that holds the fin in the holes in the slick (underside) of the softboard is typically all in one piece. The traditional fins have two threaded holes or bosses that receive nylon screws that screw in from the deck (top board surface) are located in the bosses. Installation can take up to an hour; if the screws, fin-holes and bosses are not lined up properly and/or the wrong length of screws are used further delays can be the outcome. This can result in a very frustrating time and an imperfect fit in which loose fins are not tightly secured to the board resulting in undesirable play therewith on the underside of the softboard. This can be a serious problem because of the damage that may be caused to the softboard. Moreover, it is desirable to minimize water resistance in this section of the board.

Removal of fins from softboards, once installed, is even more difficult. Often, the nylon screws are cross threaded during installation and need to be cut out. Such problems in installation and removal have meant that fin damage may result in the need to replace the softboard itself. Moreover, replacement of fins with a superior model on an existing board to improve performance or to adapt to particular surf conditions is problematic for the above reasons and is discouraged.

Accordingly, this invention is an advance on unitary fin and base constructions, which are generally manufactured in a non-rigid material having the same sort of hardiness as, for example, skateboard wheels. Prior art fins may be fixed to a softboard by means of two large headed screws, typically made of nylon, which pass through holes in the board and tighten in protruding bosses on the underside of the fin and base moulding. The resilient nature of the fin material means that the fixing screws can fix firmly in the bosses regardless of the depth of engagement, without undue pressure having to be applied to the soft deck surface and ensuring the screws will not come loose because of the lock fit arrangement.

It is an object of the present invention to provide a fin attachment, box, set, module and/or system that may overcome or ameliorate the above shortcomings, or which will at least provide a useful alternative.

DISCLOSURE OF THE INVENTION

In one aspect, the invention provides a fin module for attaching a fin to a surfboard comprising a top deck, a core, an underside, and a bore extending through the core between the top deck and the underside, the fin module including:

- a fin comprising a core and extending base portion made of substantially rigid material and a cover forming a fin blade made of substantially resilient material; and
- a fin box made of a substantially rigid material and having a cavity for receiving the base portion, wherein:

- the fin box is formed separately to the fin and adapted to receive interchangeable fins of like construction;
- the fin box is adapted to engageably receive an engagement end of a connector having a head anchorable at or near the deck and an elongate member extendable through the core, the connector operable to pull the fin box toward the connector head to adjustably space the connector head from the fin box.

In another aspect, the invention provides a fin attachment for attachment to a surfboard, the fin attachment comprising a fin, and a separate fin box having a cavity for securely receiving a base portion of the fin and adapted to receive a connector fastener extending through the surfboard to secure the fin box to the surfboard.

Accordingly, the present invention includes the splitting of the fin and base into two parts, a fin with a fixing base or tab and a separate fin box. This inventive arrangement allows the fin box to be factory fitted to the softboard without increasing packaging volume and also allows the board rider to change fins when desired. The fin box made according to preferred embodiments of the invention may accept, interchangeably, fins based on the popular FCS fixing system.

The surfboard may be made from a variety of suitable materials common in the art. It is preferred that the surfboard is a softboard, made of any suitable material, such as those mentioned above. The surfboard may be a softboard having a relatively soft material core that withstands minor compressive, but not tensile, forces to retain structural integrity.

The surfboard may include more than one bore and, typically, will include two spaced bores for each fin according to a standard surfboard arrangement. The fin module preferably includes a boss to receive the connector engagement end. The boss may receive an insert, the connector engagement end being engageable within the insert portion in the boss. The insert may be in the form of a plug forming an internal lining within the boss. The insert may be made from a softer and/or more resilient material than the fin box and the connector. The insert may frictionally engage the engagement end to prevent inadvertent loosening of the connector relative to the fin box. The insert may be optionally threaded. The engagement end may also be threaded in accordance with typical polyamide (such as nylon) bolts used to secure fins to softboards. The connector may therefore be threaded and may self-form a thread in the softer material of the insert or may cooperate with an existing or pre-formed insert thread.

The boss may define a chamber that is substantially cylindrical. The boss chamber may include an internal, wall feature that cooperates with a complementary insert feature to prevent rotation of the insert in the boss. The insert may be permanently moulded in the boss or may be separable and replaceable.

The fin module may be configured to attach more than one fin to the surfboard. The fin box may include more than one cavity to receive a plurality of fins. However, typically the fin box includes a single cavity adapted to receive a mounting member of a single fin. More than one fin module may be used on a particular surfboard, for example, to provide a twin, triple or quad fin arrangement. The cavity may define a horizontal engaging surface in, for example, a cavity having a cross-section in the shape of an upside down T or L so that the fin mounting member is positively trapped in the cavity.

The cavity may be a central, longitudinally aligned cavity in the form of a slot. Preferably, the cavity comprises a channel shaped slot and the fin base portion includes a corresponding mounting edge, such as a correspondingly shaped bar or plurality of tags, to fit into the slot. The cavity may be an elongated slot adapted to receive most fins. The fin module may include as many inserts as there are bores in the surfboard, as well as a corresponding number of connectors.

The fin box is made of a substantially rigid material according to the preferred form of the invention and may have a central rectangular recess or cavity, which meets with the base portion of the fin. A plurality of grub screws, usually four with pair on either side of the base portion, are set at an angle to the vertical to engage with the base portion and are so aligned and positioned that when tightened, they clamp the base portion or fin plate in place.

In an alternative arrangement, the connector engagement end may include a head or hook that is trapped by a shoulder in the boss chamber in the fin box.

Preferably, the fin box has an outer chamfered edge and the chamber has a cover to close the opening to the chamber. Preferably, the fin box includes two spaced chambers, but can include one, three or more. The fin box peripheral wall preferably includes a downwardly depending, shallow peripheral flange. The peripheral flange is adapted to shallowly indent into the softboard slick surface. This advantageously mitigates the tendency of a planar plastic plate to lift at the edges whereby to open a gap between the fin box periphery and the softboard slick surface. Such a gap undesirably allows play, and may increase wear and tear and potentially permanently damage the softboard.

The connector head may be in the form of an anchor and may be a cap, insert, stopper or plug adapted to seal the bore at or near the deck surface. The anchor may include a variety of forms adapted to locate at or near the deck. The anchor is advantageously adapted to prevent the anchor from being pulled through the core or to compromise the integrity of the core adjacent the bore or near the deck surface.

The connector head may include a broad surface member, such as a planar flange, locatable at or near the top deck surface. The broad surface or an extension of the connector head may be recessed into the deck surface. The broad surface may be circular, square, oval shaped or any other suitable shape in plan, but is preferably oval or circular to avoid sharp edges. The connector head may be a fastener head, such as a bolt head and the connector head preferably includes drive receiving means, such as a slot or cross slots to engage a screw driver, or a hex or other polygonal head or recess to engage a spanner or hex (alien) key. The connector elongate member extends through the bore to the fin box and preferably the chamber. The chamber may include an aperture to receive the connector. The chamber aperture is preferably coaxial with the bore and the connector.

In the alternative arrangement, the anchor may threadably receive the engagement end, the connector is a bolt and the head is trapped in the chamber and operable by a screw driver, hex key, spanner or the like.

The insert may be made of a variety of materials, including plastic and rubber, or a composite thereof. Preferably, the anchor is composed of a material or combination of materials that is/are sufficiently soft to enable the threaded shaft to cut a thread or spiral groove into the internal surface of the recess without there being a pre-formed anchor thread or in order for the insert to hold the connector thread in a friction tight relationship so that the threaded connection does not inadvertently loosen. Alternatively, the recess thread in the insert may be pre-formed. The insert may therefore provide a lock-fit thread.

The connector may include a variety of items adapted to engage with the fin box. The connector may include a tension wire or rod. The connector is preferably a fastener with good compression and tension-resistant properties so that the core is not crushed or otherwise weakened at the location where the fin module is attached. The connector may be an elongate fastener. The connector may be a screw or bolt in which the elongate member is a threaded shaft. The elongate member may be fastened to the fin box by no positive or friction engagement. The elongate member preferably is threadably received in the fin box but may be otherwise attached by, for example, a ramped step, sprung ball or a pivotal disc engageable to a complementary step or groove formed in the connector shaft.

The insert may be in the form of a plug. Where the fin box has a pair of spaced bosses, the first and second bosses may each be adapted to receive corresponding first and second inserts.

Accordingly, in another aspect there is provided a fin box for a surfboard having a deck and a slick, the fin box having a cavity for receiving a base portion of a fin; and first and second bosses, each adapted to receive a screw or other attachment means entering the surfboard from the deck. The first and second bosses are preferably spaced from each other at or near either end of the fin box. In one embodiment, the first and second bosses are located in the same regions as presently used for fin box screws.

This invention also provides a fin system, the system including a fin box for a surfboard having a deck and a slick, the fin box having a cavity for receiving a base portion of a fin; first and second screws or other attachment means; first and second plugs, each adapted to receive the first and second screws or other attachment means entering the surfboard from the deck; and means for securing the fin in the cavity.

The invention also provides the fin box, or the fin system, in combination with a fin, and a surfboard including one or more of the fin box, the fin system or either in combination with a fin. Even more preferably, the invention provides a surfboard in combination with three or four of the fin boxes, the fin system or either in combination with a fin.

In another aspect, the invention provides a fin for a surfboard, the fin having an inner core of a material of greater hardness than the remainder of the fin, the inner core integral with a fin base that is engageable to a separate fin box for attachment to a surfboard. Preferably, the fin has a reinforcing centre made of harder material than the remainder of the fin. Preferably, the reinforcing centre comprises three bars joined in a triangle. Preferably, the bars are thick in elevation and thin in plan view. Preferably, the apex of the reinforcing centre extends to about half the distance of the fin apex from the underside of the surfboard. Preferably, the inner core and particularly the triangular bar lies substantially in a single plane and has a consistently narrow width.

Preferably, the fin of the invention is combined with the fin box or fin system of the invention and is provided in the form of a modular kit. Optionally, the one or more fins include one or more of a variety of fins fittable to the fin box. Preferably, the fin box receives only one fin at a time.

The fins may vary in size, shape and materials in accordance with commercially available surfboard fins. For small fins, the boss may be within the footprint of the cavity. For larger fins, the boss may be located outside the cavity, and, where there are a pair of spaced bosses, preferably near either end of the cavity. The fun may be asymmetric with reference to a vertical plane in which the fin substantially lies, and biased to one side or another, thereby being suitable for a right- or left-hand side fin.

The means for securing the fin in the cavity are preferably grub screws set at an angle to the fin, but may take any other form, including a friction fit. The base portion of the fin may include a recess in a side wall received in the cavity to receive an abutting end of each grub screw.

By moulding the fin blade and fixing base or tab from two different materials, this preferred form allows the fin to be secured in the fix box by grub screws without damage to the fin as the grub screws engage only the hard material of the base or tab. The fixing base or tab is preferably rectangular, with recesses in the side laces to give a lip for the grub screws to engage.

The fin comprises a blade and a base or tab. The fin of the invention is a combination of soft and hard materials. In a preferred embodiment, the hard material is a compound moulded to form the base portion (in the form of a bar or one or more or tabs) and also as the fin blade "core" and the outer soft material is a compound moulded around the hard core to form the outer covering of the fin blade. Preferably, the fin box is made of a hard material.

The hard/rigid material at the base portion or base/tab allows the fixing grub screws to firmly locate the fin in the fin box. The softer material of the fin allows the fins to be used on a board to be ridden "between the flags" at Australian beaches, and is a safety feature. This system allows the softboard to be purchased with a set of soft fins for beginners, and then to be upgraded to hard fins as the rider becomes more proficient. It also allows the manufacture of a range of fins of different softness—thus affecting the feel of the board. By using varying combinations of hard and soft material, different fin characteristics can be obtained. One or more grades of soft material can be used in combination with the hard base/tab and different grades of hard material may be used for the base portion and core to achieve different properties of flex, strength and resilience.

It will be appreciated that in preferred embodiments the fin box and system of the invention effectively separates the fins from the fin-box (or anchors/plugs), which means the following is realised: the fin-box and screws can be fitted at the manufacturers and only fins need be inserted (with consummate ease) by the retailer or consumer—the female plugs that accept the screws can be positioned based on the same design or the old system, to enable retrofitting. Many existing fins made of hard material can be incorporated in the inventive arrangement. When the fins are inserted/installed, the user need only use an alien key to screw in four "grub" screws to ensure a tight fit. This would not work as effectively with fins having a soft material base as the screws may damage the softer fin material. In this regard, the invention provides a removable and/or replaceable soft fin or a fin including soft material in the fin blade. Heretofore, this has not been provided for fins for either softboards or surfboards.

The separate plugs or inserts within the fin-box can allow the screws to grip at any depth. Plugs may be made of a resilient material; the fin box may be made of a rigid material. This allows the plugs to be a tight fit on the screw thread, giving a locked thread at any depth. The hard material for the fin box can allow the use of grub screws to hold the removable fin in place. The plugs can be interchangeable for different gauge male screws. The edge of the fin box may be chamfered to be more streamlined than the previous system.

BRIEF DESCRIPTION OF THE DRAWINGS

The invention may be better understood from the following non-limiting description of preferred embodiments, in which.

Figure 1:
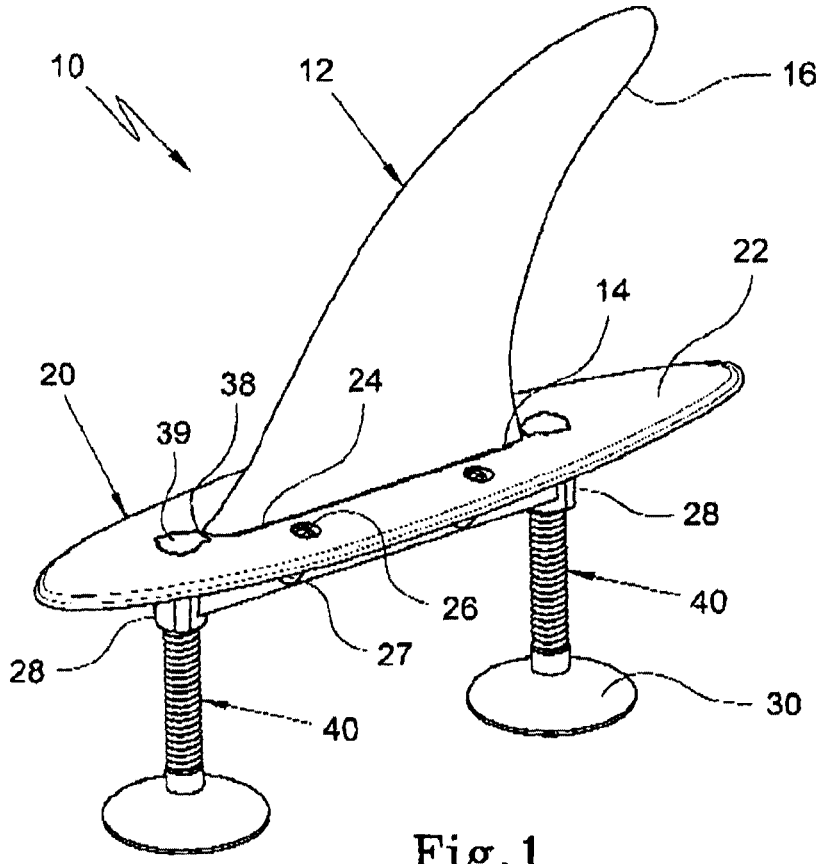
FIG. 1 is a perspective view of a fin module according to a first embodiment of the invention.

The drawings will be described with reference to the fin being uppermost as shown in the drawings for the sake of convenience. However, it will be appreciated that in use the fin will generally be down-most in water. In the drawings there is shown a fin module 10 comprising: a fin 12 having a base 14 and blade 16; a fin box 20 comprising a box plate 22, fin tag receiving slot 24, grub screw fasteners 26 locking the fin blade base 14 into the slot 24 and a pair of spaced longitudinally aligned bosses 28 comprising chambers 29 extending normal to the box plate 22; a pair of spaced plugs 50 substantially coaxially aligned with and in their respective chambers 29; and a pair of threaded bolts 40 connecting to the bosses 28.

The slot 24 extends between the bosses 28 with the opening to the slot 24 extending along the upper surface 25 of the box plate 22. The slot 24 defines a longitudinally aligned channel of rectangular cross-section according to standard surfboard fin design, so that a variety of different fins 12 may be inserted in the fin box 20. The grub screws 26 extend through inwardly inclined bores 27 from an entry point in the upper surface 25 of the box plate 22 so that the blade base 14, which is rectangular in cross-section and complementary in shape to the slot 24, is fixed rigidly in place in the slot 24.

The bosses 28 are located at either end of the slot 24 and depend normally down from the lower surface 23 of the fin plate 22. The bosses 28 each define a chamber 29 within which the threaded engagement end 32 of the bolt 40 is secured. The bolt 40 has a threaded shaft 42 optionally with aggressive flights 44 that may be adapted to cut into the relatively soil material of the plug 50 to form a complementary thread in an internal bore 52 of the plug insert 50. The bolt 40 has a radial flange 36 extending from a neck 37 to be located in a bore (not shown) of the surfboard 8 (shown in FIG. 20).

Flush with or slightly recessed from the upper surface 25 of the box plate 22 at the upper end 58 (see FIG. 24) of the insert plug 50 is a closed end, a sealable cap or a hinged lid 39 that can be flipped about its hinge 38 to open or close the chamber 29. However, in the preferred embodiment, the upper plug end 39 is closed, thereby scaling the chamber 29 once the insert plug 50 is installed in the chamber 29. The cap 39 provides access to the chamber 29 to enable an operator, to access the engagement end 32 with a suitable tool, such as a pair of pliers or the like should it be necessary, to rotate the engagement end 32 relative to the chamber 29, for example, where the bolt head 30 is snapped off in use. The bolt 40 may be rotated by, for example, a screw driver or even a coin relative to the plug insert 50 whereby to vary the spacing between the bolt anchor 30 and the boss 28 to conform to the particular thickness of an individual surfboard.

Figure 5:
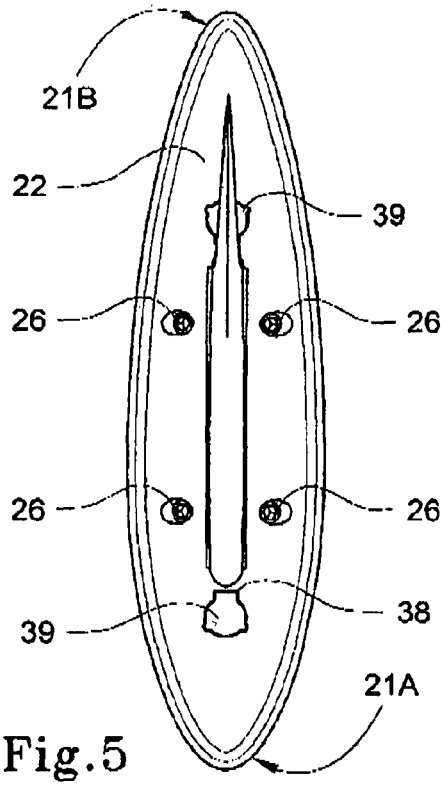
FIG. 5 is a top plan view of the fin module shown in FIG. 1.
Figure 6:
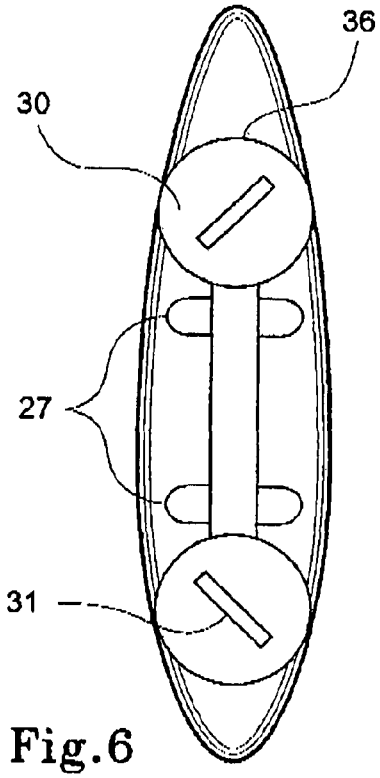
FIG. 6 is a bottom plan view of the fin module shown in FIG. 1.

In plan view, as shown in FIGS. 5 and 6, the box plate 22 has a similar shape to a typical surfboard, with a generally fusiform shape that is broader toward the front box end 21A and tapering more narrowly toward the rear box end 21B and the box plate 22 is generally planar whereby to conform to the shape of the surfboard surface along a short longitudinal section of the underside slick surface. The box plate 22 is sufficiently broad in surface area to distribute the forces applied to the surfboard through the buffeting to which the fin 12 (FIG. 1) is subjected. Accordingly, the box plate 22 is preferably shaped to have rounded, rather than sharp, corner edges and to lie flat, if not flush, with the underneath slick surface.

Similarly, the bolt anchors 30 present, through their radial flanges 36, a relatively broad surface area to evenly distribute the compressive forces that may be applied to the upper deck surface by the buffeting of the fin 12 (FIG. 1). The outer surface of the radial flange 36 has on its outer surface a key slot 31 to enable the bolt anchor 30 to be rotated relative to the boss 28 (see FIGS. 1 and 2).

Figure 7:
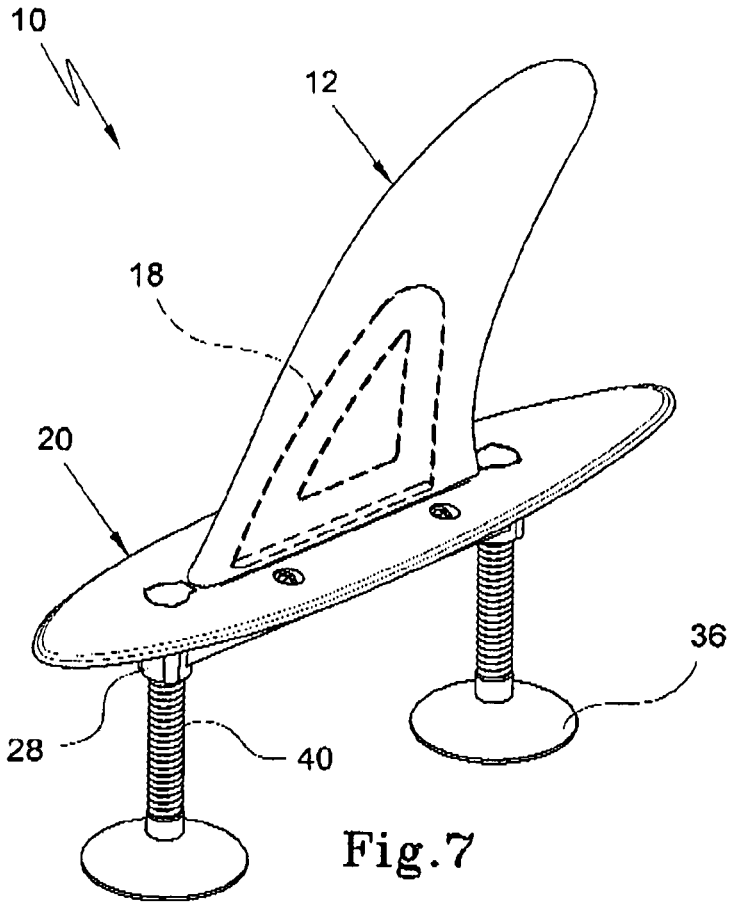
FIG. 7 is a perspective view or the fin module shown in FIG. 1.
Figure 8:
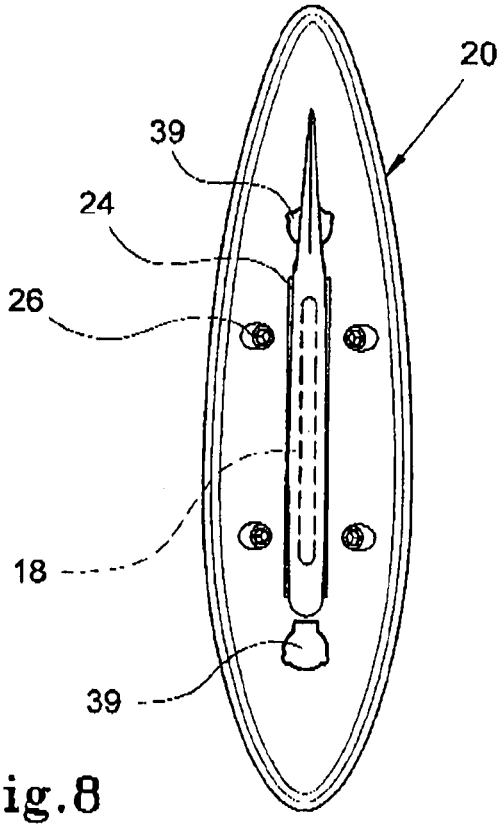
FIG. 8 is a top plan view of the fin module shown in FIG. 1.
Figure 9:
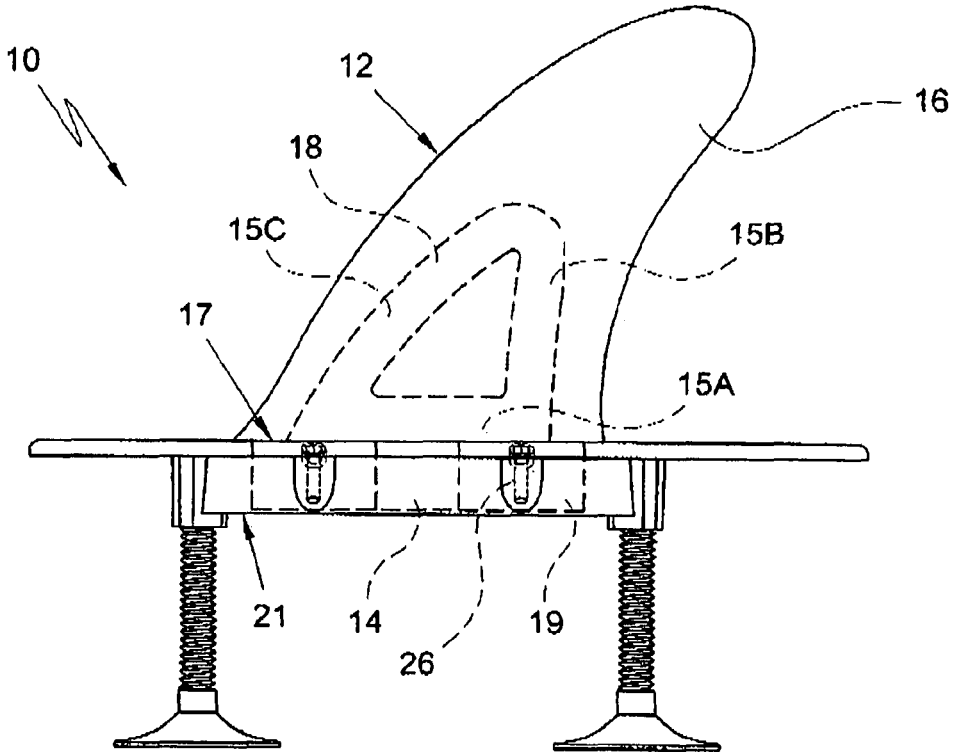
FIG. 9 is a side elevation of the fin module shown in FIG. 1.

FIGS. 7-9 show a fin module 10 with a reinforcing core 18, as shown by dashed lines, comprising a rigid base or tag 14 that slots into the elongate slot 24. The rigid tag or base 14 may be in the form of a base having a rectangular cross-section comprising a solid beam 17 extending the full length of the slot 24. Alternatively, the fin 12 may be mounted to the fin box 20 by a pair of rectangular cross-sectioned tags 19 that similarly fit into the slot 24 and are engaged in fixed relationship with the slot 24 by the grub screws 26.

The core 18 is made of harder and more rigid material than the remainder of the blade 16 and provides a strong mounting arrangement, and rigidity and strength in the fin blade 16 structure, whilst the softer remainder of the fin blade 16 is formed around the core 18 using a moulded softer material to enable the fin 12 to be used between the flags on patrolled beaches or otherwise in relatively congested surf where collisions with other swimmers or surfers are possible. The core 18 is triangular in shape and includes three joined bars 15, including a base bar 15A, a rear vertical bar 15B extending substantially normal to the base bar 15A, and a frontward inclined bar 15C. The bars 15A, 15B, and 15C are preferably integrally formed with the beam 17 or tags 19 and are much wider in side elevation, as shown in FIG. 9, than in plan view as shown in FIGS. 8, 10 and 11.

Figure 10:
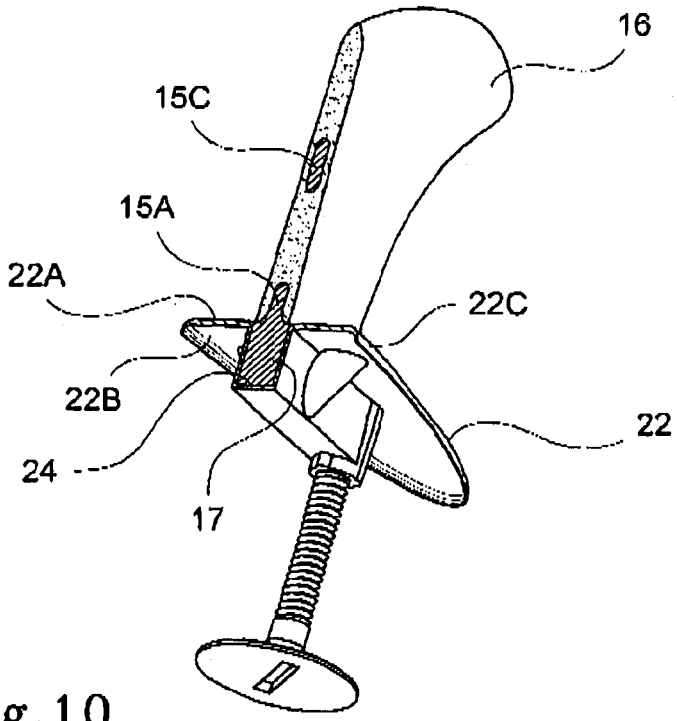
FIG. 10 is a cross-sectional perspective view of the fin module shown in FIG. 1.
Figure 11:
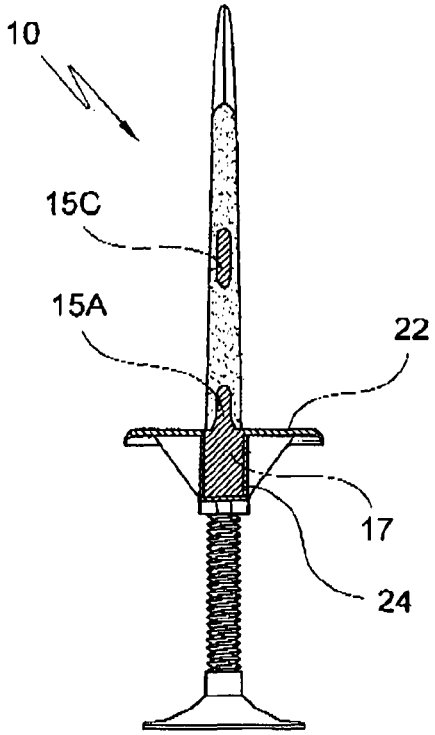
FIG. 11 is a front sectional view of the fin module shown in FIG. 1.

With particular reference to FIG. 10, a top surface 22A of the box plate 22 is generally planar and extends to a peripheral edge that curves downwardly. The underside 22B of the box plate 22 together with the downwardly depending peripheral edge 22C defines a shallow recess under the box plate 22. When the box plate 22 is pressed against the underneath slick surface, the downwardly depending peripheral edge 22C engages the slick surface and, in combination with the recessed underside 22B, prevents the peripheral edge 22C from tending to lift off the slick surface. The peripheral edge 22C consistently abuts the slick surface around the edge of the box plate 22 by indenting into the slick surface. Alternatively, the planar box plate 22 may be permitted to marginally bow or at least for tension to be created in the horizontal portion of the box plate 22 structure, urging the horizontal portion to assume a shallow concave top surface 22A and urging the peripheral edge 22C hard against the slick surface.

Figure 12:
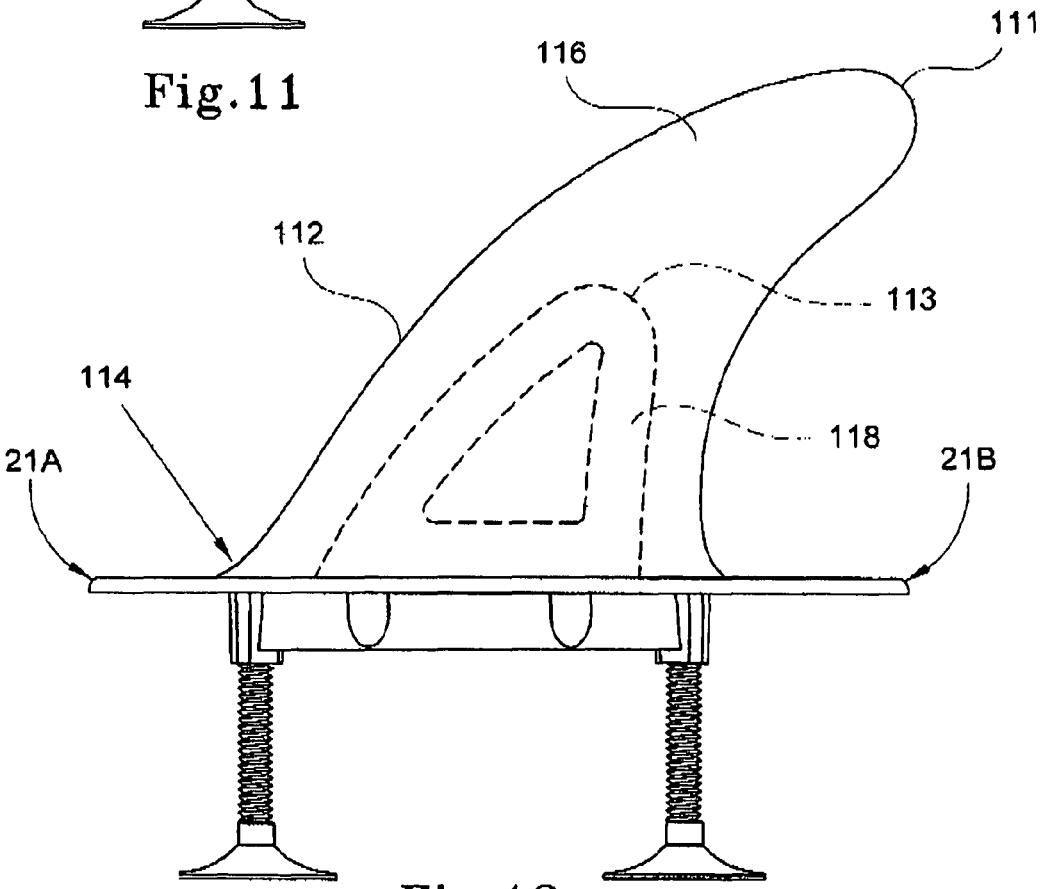
FIG. 12 is a side elevation of a fin module according to a second embodiment of the invention.
Figure 13:
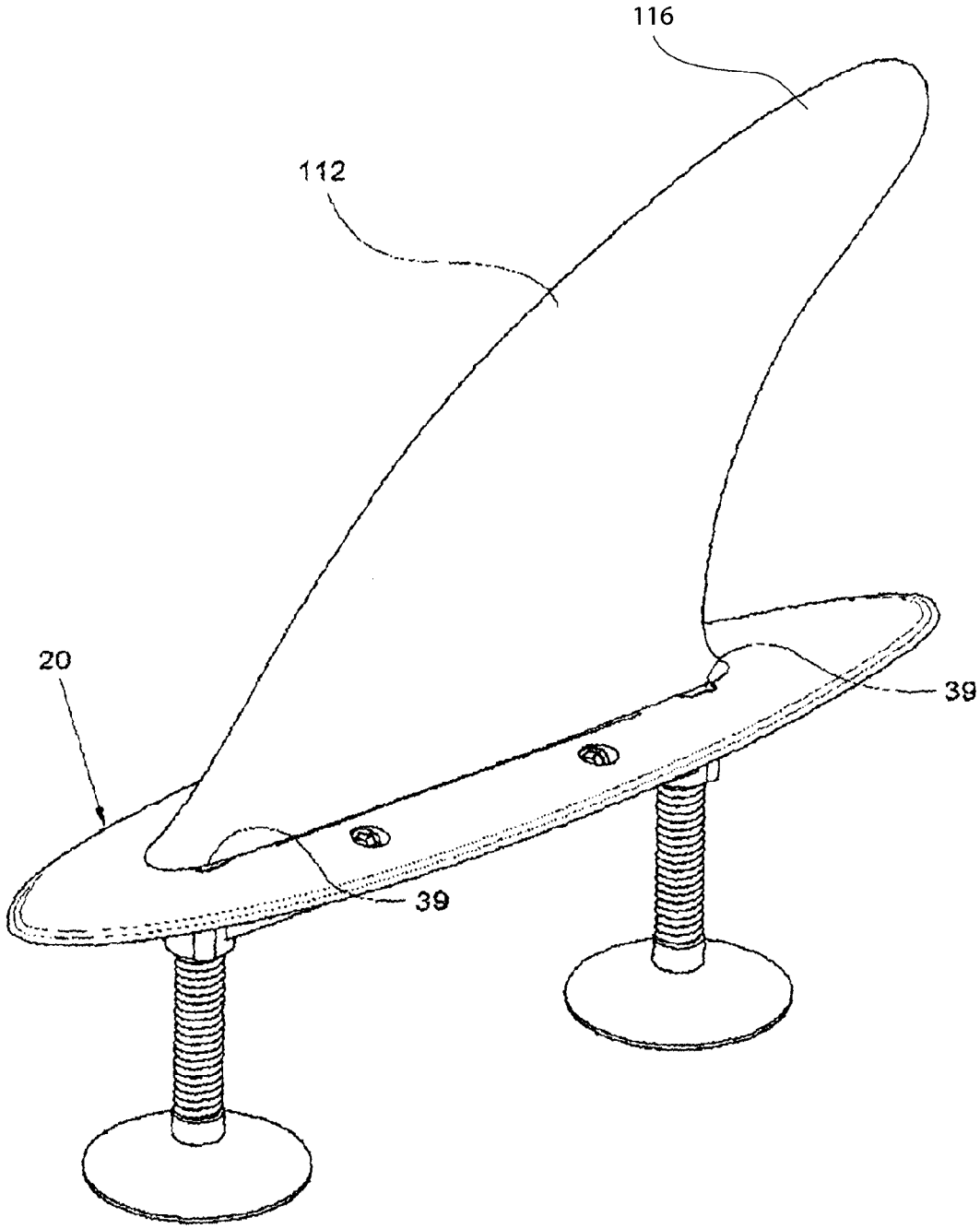
FIG. 13 is a perspective view of the fin module shown in FIG. 12.

In FIGS. 12 and 13, there is shown a fin 112 having larger dimensions than the fin 12 (FIG. 1) and having a correspondingly larger reinforcing core 118, as shown by dashed lines. In any case, the core 118 has similar relative proportions compared to the remainder of the blade 116, having an apex 113 that extends about half the length of the large blade 116 from the front 114 of the blade 116 to the apex 111. The footprint of the large fin 112 overhangs the rear 21B of the box is plate 22. The lowermost portion of the blade 116 extends over the insert ends 39, so that the large fin 112 must be mounted to the fin box 20 (FIG. 1) after the fin box 20 is mounted to a surfboard. Accordingly, the fin box 20 is mounted to the surfboard first, and then the large fin 112 may be mounted in the fin box 20.

Figure 14:
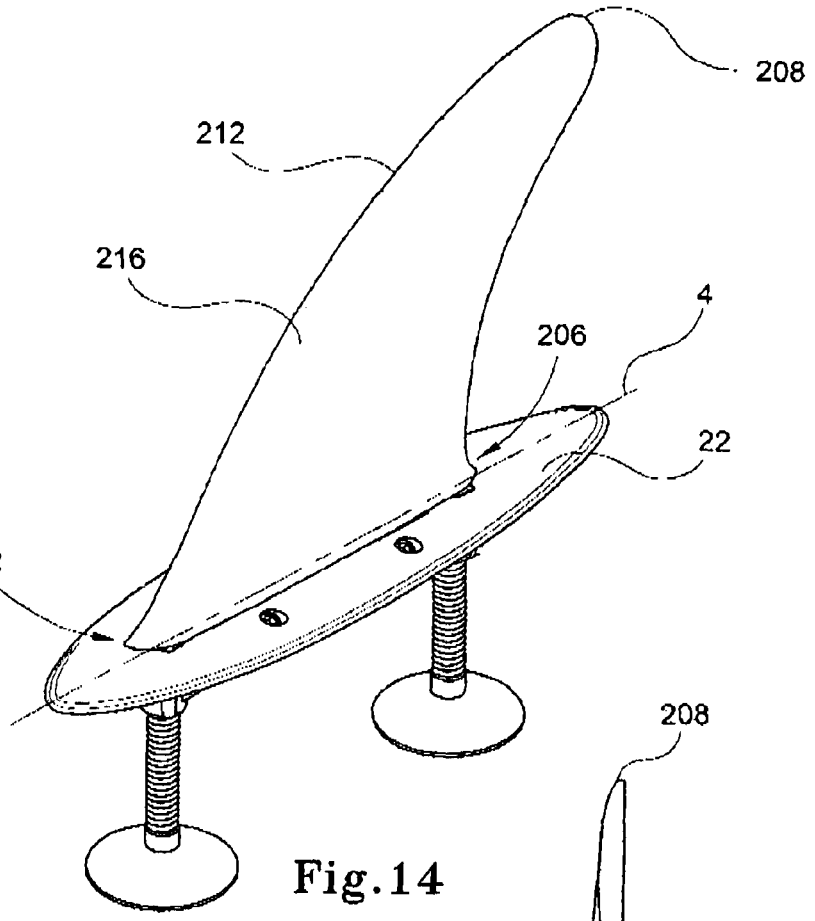
FIG. 14 is a fin module according to a third embodiment of the invention.
Figure 15:
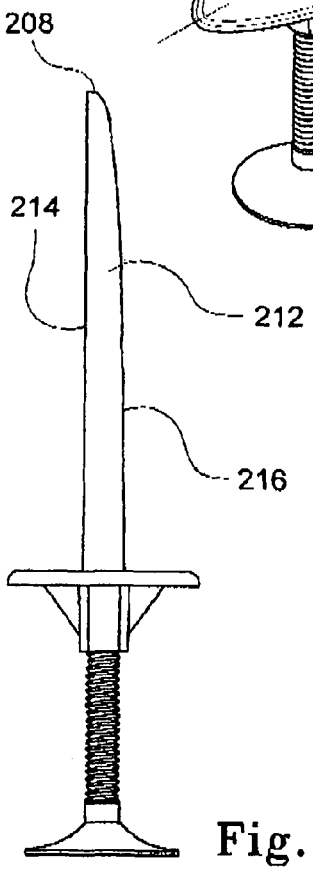
FIG. 15 is a front elevation of the fin module shown in FIG. 14.

In another variation of a fin that may be mounted to the fin module 10 of the present invention, as shown in FIGS. 14 and 15, a fin blade may be convex on a first left-hand side 216 when the fin 212 is considered to face toward the front. The fin 212 is substantially planar on the opposite right-hand side 214 to make it suitable for use as a left- or right-hand side fin, as exemplified by large left fin 212. It can be seen that the large left fin 212 front section 202 is moulded so that, its left-hand side surface 216 curves to the right at its extremities. The fin 112 edges lie off the line of the longitudinal axis 4 of the box plate 22. On the other hand, the left-hand side surface 216 remains generally planar along its base length and lies consistently outside and adjacent to the longitudinal axis 4. The rear portion 206 and the rear apex portion 208 of the large left fin 212 on the left-hand side surface 216 curve to the right and over the longitudinal axis 4 thereby forming the slightly convex surface 216. This improves the hydrodynamics and stability for turns in the surf as the surfer leans to that side of the board on which the large fin 212 is curved.

Figure 16:
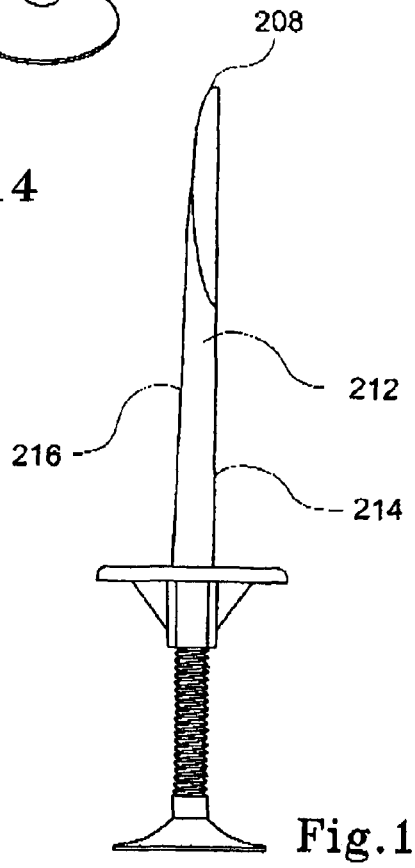
FIG. 16 is a rear elevation view of the fin module shown in FIG. 14.
Figure 17:
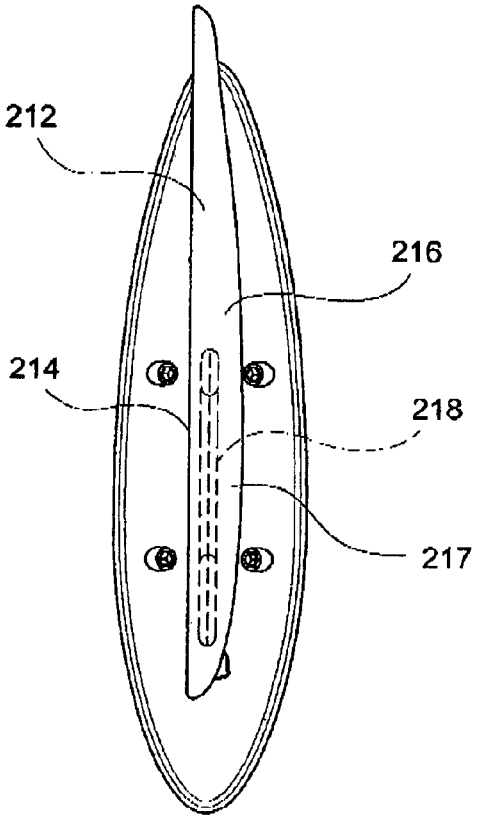
FIG. 17 is a top plan view of the fin module shown in FIG. 14.

With reference to FIGS. 16 and 17, the shape in plan of the large tell fin 212 is shown having the substantially planar right-hand side surface 214 and the generally shallow convex left-hand side surface 216, the intermediate section 217 of the large left fin 212 being thicker to accommodate the reinforcing core 218 inter-moulded therein.

Figure 18:
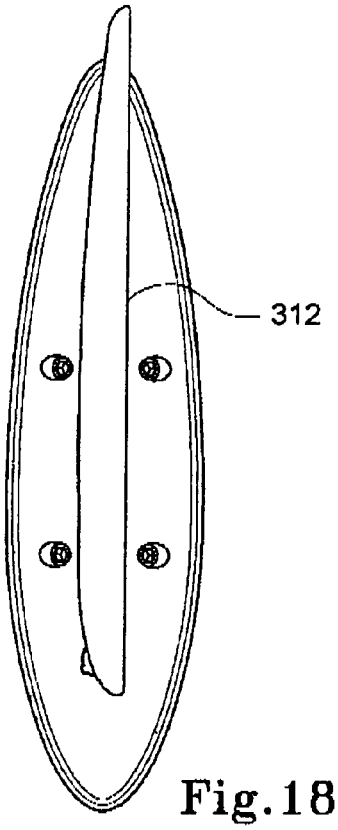
FIG. 18 is a top plan view of a fin module according to a fourth embodiment of the invention.
Figure 19:
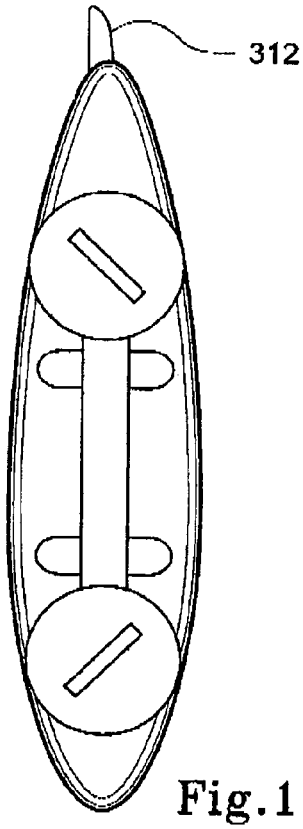
FIG. 19 is a bottom plan view of the fin module shown in FIG. 18.

A left-hand large fin 312 is also provided, according to the invention, as shown in FIGS. 18 and 19.

Figure 20:
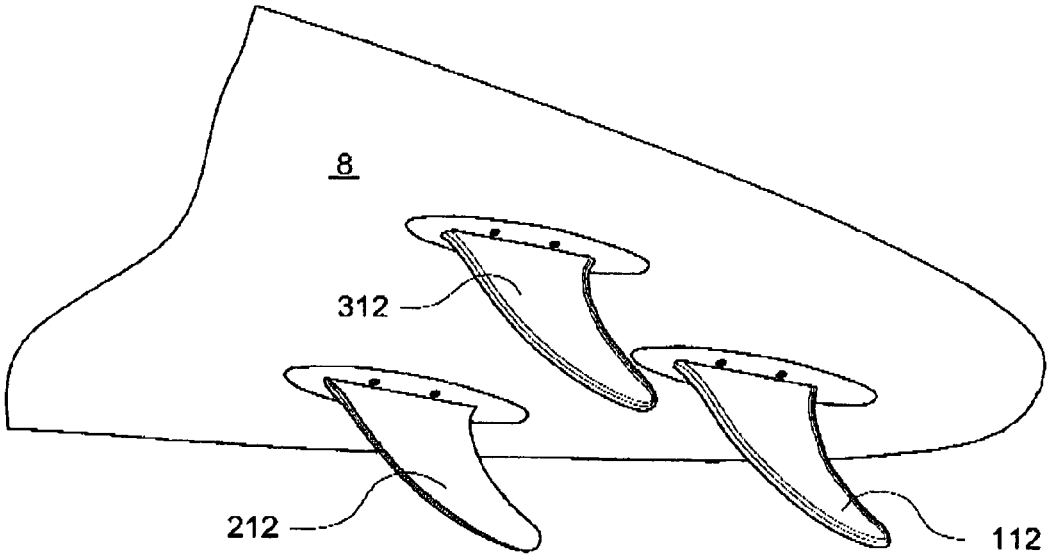
FIG. 20 is a perspective view of a surfboard on which are mounted a triplet of fin modules according to the invention.

As shown in FIG. 20, a triplet of fin modules 10, 112, 212 and 312 may be mounted to a surfboard 8, such as a softboard as previously described, with a central straight large fin 112 and left and right side fins 212, 312. In another embodiment, the left and right fins 212, 312 may be short fins combined with a long central fin 12 (FIG. 1) to make up a triplet to enable easier turning and general maneuverability. Alternatively, the left and right fins 212, 312 may be replaced with small straight fins where the rider prefers more directional surfboard 8 travel.

Figure 21:
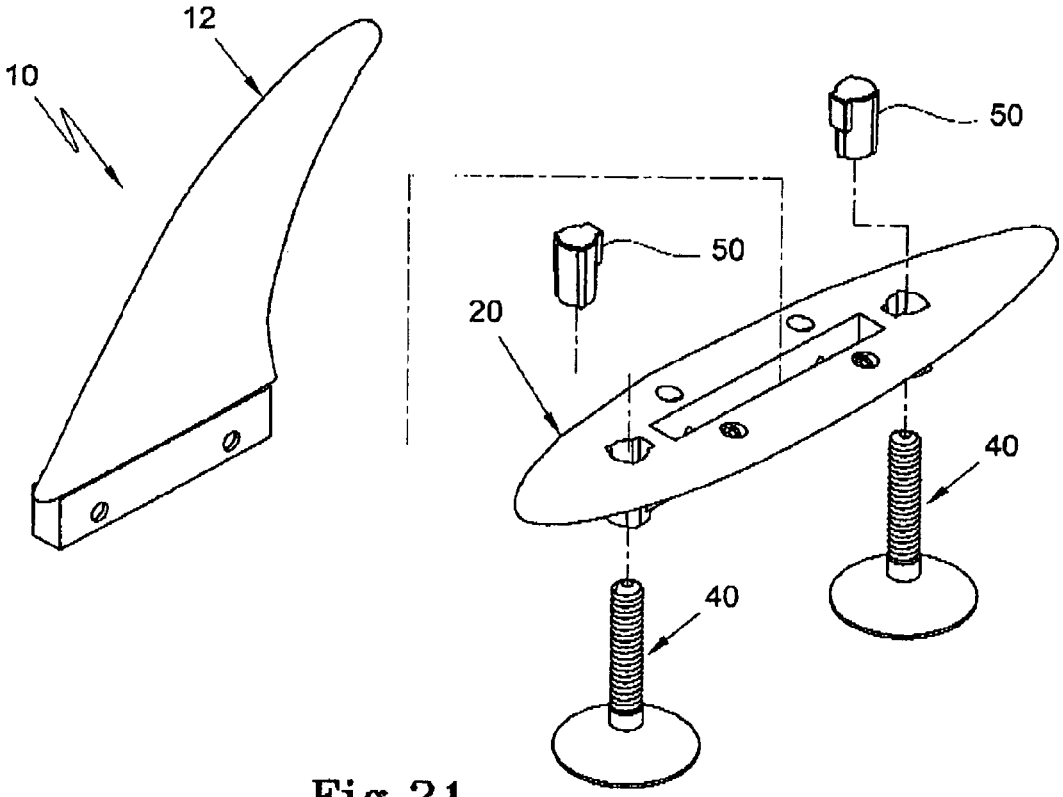
FIG. 21 is an exploded perspective view of a fin blade and fin box according to one embodiment of the invention.

Referring to FIG. 21, there is shown an exploded view of a fin module 10 comprising the fin 12, insert 50, fin box 20 and bolts 40. The fin module 10 is assembled by placing the fin box 20 into a preformed board cavity making space in recesses for the downwardly depending bosses 28 (FIG. 1) and the slot housing 21 (FIG. 8) in the slick surface of a surfboard 8 (FIG. 20). The box plate 22 (FIG. 1) therefore lies flush with the slick surface and the bosses 28 extend into countersunk bores within the surfboard 8. Inserts 50 are inserted into the chambers 29 of the bosses 28 as will be described in more detail below. The bolts 40 are inserted from the other deck side of the surfboard 8 and threadably engaged by their engagement ends 32 with the inserts 50 (FIG. 2) so that the fin box 20 is drawn into a tight spaced relationship with the bolt heads 30 (FIG. 2) sitting substantially flush with the deck surface of the surfboard 8. The base or tag 14 of the fin 12 is inserted into the slot 24 and secured in place by abutting engagement with grub screws 26 extending through the inclined shafts 27 (FIG. 1) in the box plate 22 and slot housing 21.

Figure 22:
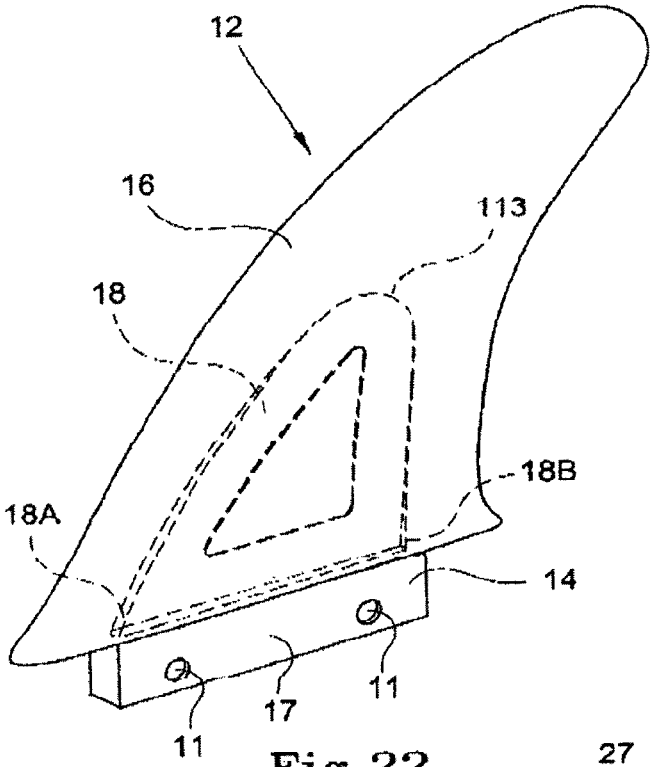
FIG. 22 is a perspective view of a fin blade showing detail of the base portion.

Detail of the fin 12 is shown in FIG. 22 where the base 14 in the form of a beam 17 is clearly shown. The rectangular beam 17 includes a pair of recessed cavities 11 adapted to receive the abutting ends of the grub screws 26 whereby to firmly lock the beam 17 in place in the slot 24. The triangular core 18, as shown by dashed lines, can clearly be seen to taper in width from the base 14 up to the core apex 113. Furthermore, the width of the triangular core 18 may taper from the front of the core 18A through to the rear of the core 18B.

Figure 23:
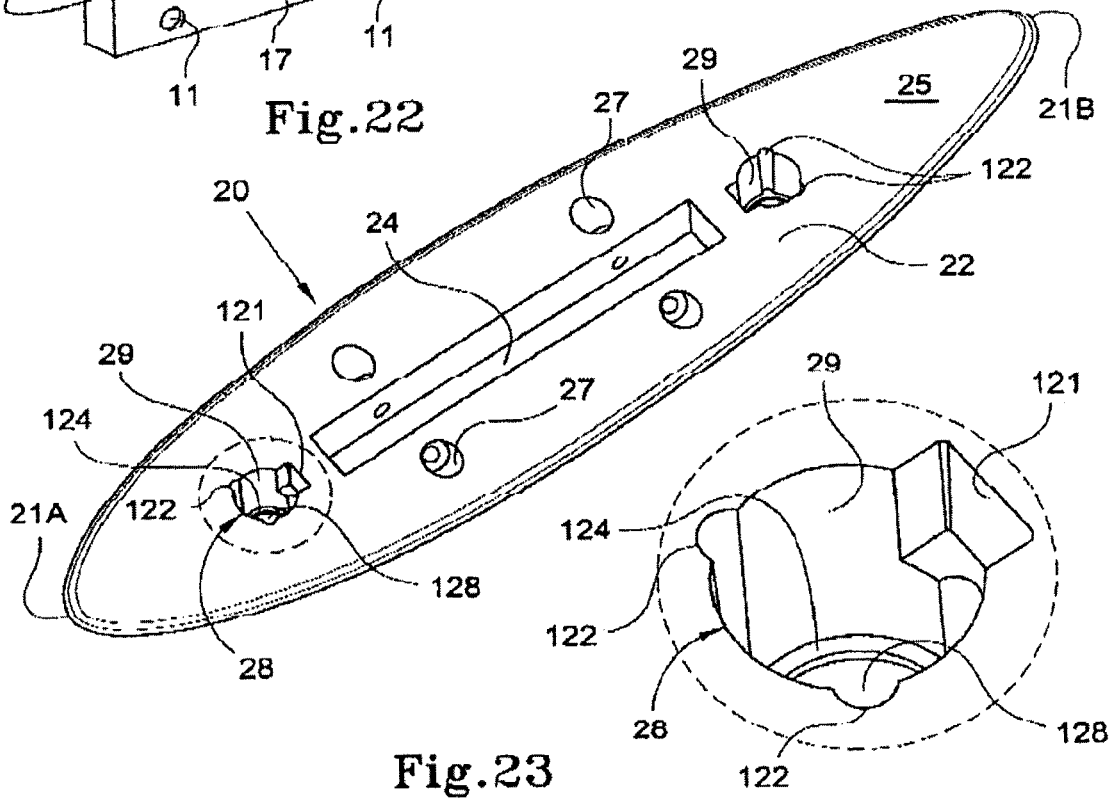
FIG. 23 is a perspective view of a fin box according to one embodiment of the invention showing detail of the slot and bosses.

In FIG. 23, there is shown the detail of the fin box 20 from an upper view. In particular, it can be seen that the boss 28 defines a chamber 29 that is counter bored from the top surface 25 of the fin box 20, rather than being solid with an internal thread as in the prior art. The bosses 28 also have a hole 128 through which the engagement end 32 of the bolt 40 extends. The chamber 29 includes surface features 121, 122 in the internal side walls of the chamber 29. The surface feature in the form of a longitudinal slot extending part way down the length of the chamber 29 terminates intermediate the length of the chamber 29. The chamber 29 also includes longitudinal grooves 122 extending the length of the chamber 29. The plug or insert 50 is introduced to the chamber 29 with the narrow end 59 (see below) leading into the chamber 29.

Figure 24:
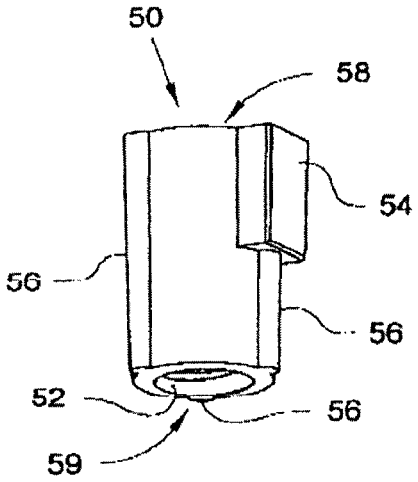
FIG. 24 is a perspective view of a plug or insert according to one embodiment of the invention.

Referring to FIG. 24, the insert plug 50 comprises a substantially cylindrical body that is wide at its upper end 58 and marginally tapered toward its lower end 59. The insert 50 includes a lower aperture 52 adapted to align coaxially and coextensively with the hole 128 of the chamber 29. The outer wall of the insert or plug 50 includes three equally, circumferentially spaced longitudinal ridges 56 that are adapted to locate in corresponding grooves 122 in the chamber 29 wall and the insert 50 further includes a rectangular longitudinal key 54 extending intermediate the length of the insert 50 and adapted to locate within the longitudinal slot 121 in the chamber 29.

The chamber 29 further includes a lower annular ledge 124 (FIG. 23) on which the lowermost end 59 rests. The upper end 58 of the plug or insert 50 is capped with a closed end wall whereby to substantially seal the chamber 29 on the upper surface 25 against turbulence in the chambers 29, the upper insert cap 39 (FIGS. 1 and 2) being flush with or slightly recessed from the upper fin plate surface 25. The insert or plug 50 allows existing standard polyamide fixing screws to be used to secure the fin box 20 to the softboard 8 in exactly the same manner as is used in the prior art, and maintains the prior art system's ability to be locked at any depth of engagement of the screws or bolts 40 (FIGS. 1 and 2) in the fin box 20.

Figure 2:
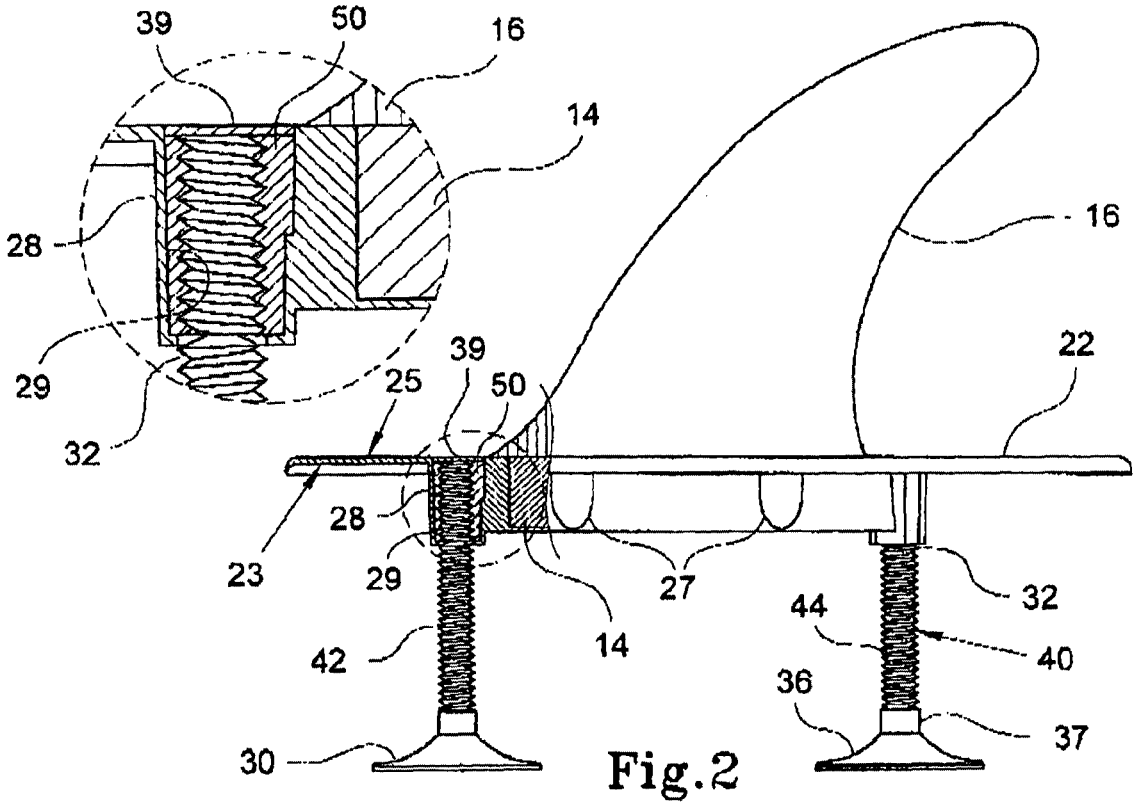
FIG. 2 is a side elevation of the fin module shown in FIG. 1.
Figure 3:
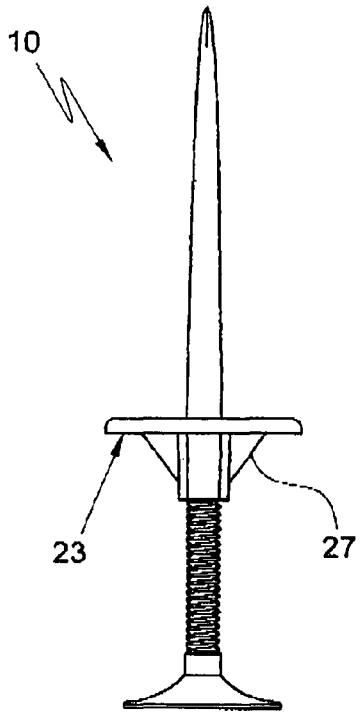
FIG. 3 is a front elevation of the fin module shown in FIG. 1.
Figure 4:
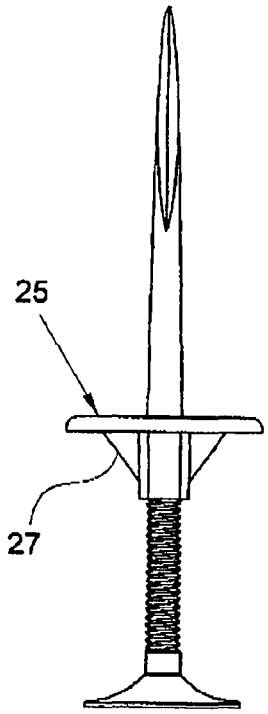
FIG. 4 is an end elevation of the fin module shown in FIG. 1.

However, unlike prior art arrangements, the fin box 20 need only be fitted to a particular softboard 8 (FIG. 20) once and thereafter a range of fins 12 (FIG. 1) may be interchangeably installed on the softboard 8 by simply loosening and consequently tightening the grub screws 26 (FIG. 1). The internal threaded plug 50 is made of a resilient material to provide lock fit engagement with the correspondingly threaded bolt engagement end 32 (FIG. 2). Furthermore, the plugs 50 external shape, namely features 54, 56, prevent the plug 50 from rotating relative to the chamber 29 to assist with effective engagement with the bolt 40 (FIGS. 1 and 2). If desired and advantageous, the plug 50 may be manufactured as a co-moulded component in the fin box 20, rather being provided as a separate insert. The inventive module 10 (FIG. 1) has been designed in its most preferred form so that it may have the same dimensions as existing prior art systems and adheres to the general principles used in known and trusted fin systems, whilst providing new and inventive advantages over the prior art.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

Orientational terms used in the specification and claims such as "vertical," "horizontal," "top," "bottom," "upper" and "lower" are to be interpreted as relational and are based on the premise that the component, item, article, apparatus, device or instrument will usually be considered in a particular orientation, typically with the deck uppermost unless otherwise specified.

Below is a table of some reference numerals used in the drawings:

| Ref. | Description | Ref. | Description |
|---|---|---|---|
| 4 | longitudinal axis of box plate | 40 | threaded bolts |
| 8 | surfboard | 42 | bolt shaft |
| 10 | fin module | 11 | grub screw recess |
| 12 | fin | 44 | aggressive flights |
| 14 | base or tag | 15A | base bar |
| 15 | triangular core bars | 15B | rear bar |
| 16 | fin blade | 15C | inclined bar |
| 17 | base beam | 18A,B | front and rear of core |
| 18 | reinforcing core | 21A | box plate front |
| 19 | tags | 21b | box plate rear |
| 20 | fin box | 128 | lower hole in boss |
| 21 | slot housing | 111 | large blade apex |
| 22 | box plate | 112 | large fin |
| 22A | box plate top surface | 116 | large blade |
| 22B | box plate underside | 113 | large core apex |
| 22C | box plate peripheral edge | 202 | front portion of large left fin |
| 23 | underside surface of box plate | | |
| 24 | slot | 212 | large left fin |
| 25 | upper surface of box plate | 312 | large right fin |
| 26 | grub screws | 114 | front of blade |
| 27 | inclined shafts for grub screws | 50 | insert or plug |
| 28 | bosses | 52 | plug bore |
| 29 | chamber | 54 | longitudinal location key |
| 30 | bolt heads or anchors | | |
| 31 | key slot | 56 | longitudinal ridges |
| 32 | threaded engagement end of bolt | 58 | narrow end |
| | | 59 | wider end |
| 36 | radial flange | 121 | chamber key |
| 37 | bolt neck | 122 | chamber groove |
| 38 | lid hinge | | |
| 39 | cap or hinged lid | | |

Those skilled in the art will appreciate that the invention described herein is susceptible to variations and modifications other than those specifically described. All such variations and modification are to be considered within the scope and spirit of the present invention the nature of which is to be determined from the foregoing description.

The invention claimed is:

1. A fin module for attaching a fin to a surfboard comprising a top deck, a core, an underside, and a bore extending through the core between the top deck and the underside, the fin module including:

a fin comprising an inner core integral with and including an extending base portion made of substantially rigid material and a cover forming a fin blade made of substantially resilient material, the substantially rigid material having a hardness greater than a hardness of the remainder of the fin; and a fin box made of a substantially rigid material and having a cavity for receiving the base portion; wherein:

the fin box is formed separately to the fin and adapted to receive interchangeable fins having a similarly extending base portion construction;

the fin box is adapted to engageably receive an engagement end of a connector having a head anchorable at or near the deck and an elongate member extendable through the surfboard core, the connector operable to pull the fin box toward the connector head to adjustably space the connector head from the fin box;

the fin box is engageable to a separate extending base portion of an interchangeable fin for attachment to the surfboard; and wherein the fin base is engageable to a separate fin box for attachment to the surfboard.

2. The fin module according to claim 1, wherein the inner core is a reinforcing center that comprises three bars joined in a triangle.

3. The fin module according to claim 2, wherein the bars are thick in elevation and thin in plan view.

4. The fin module according to claim 3, wherein the apex of the reinforcing center extends to about half the distance of the fin apex in use from the underside of the surfboard.

5. The fin module according to claim 4, wherein a multiplicity of fin units corresponding to the fin are alternatively combined with the fin box and are provided in the form of a modular kit.

6. A fin module for attaching a fin to a surfboard comprising a top deck, a core, an underside, and a bore extending through the core between the top deck and the underside, the fin module including:

a fin comprising an inner core integral with and including an extending base portion made of substantially rigid material and a cover forming a fin blade made of substantially resilient material; and a fin box made of a substantially rigid material and having a cavity for receiving the base portion;

wherein the fin box is formed separately to the fin and adapted to receive interchangeable fins having a similarly extending base portion construction;

the fin box is adapted to engageably receive an engagement end of a connector having a head anchorable at or near the deck and an elongate member extendable through the surfboard core, the connector operable to pull the fin box toward the connector head to adjustably space the connector head from the fin box;

the fin box is engageable to an extending base portion of an interchangeable fin for attachment to the surfboard;

a boss to receive the connector engagement end, wherein the boss is configured to receive an insert, the connector engagement end being engageable within the insert portion in the boss;

the insert is in the form of a plug forming an internal lining within the boss, the insert made from a softer and/or more resilient material than the fin box and the connector; and the insert frictionally engages the engagement end to prevent inadvertent loosening of the connector relative to the fin box.

7. The fin module according to claim 6, wherein the insert is internally threaded, the engagement end forming part of a threaded bolt adapted to secure the fin to a surfboard.

8. A fin module for attaching a fin to a surfboard comprising a top deck, a core, an underside, and a bore extending through the core between the top deck and the underside, the fin module including:

a fin comprising a core and an extending base portion made of substantially rigid material and a cover forming a fin blade made of substantially resilient material; and a fin box made of a substantially rigid material and having a cavity for receiving the base portion; wherein:

the fin box is formed separately to the fin and adapted to receive interchangeable fins having a similarly extending base portion construction;

the fin box is adapted to engageably receive an engagement end of a connector having a head anchorable at or near the deck and an elongate member extendable through the surfboard core, the connector operable to pull the fin box toward the connector head to adjustably space the connector head from the fin box; and the fin module is configured to attach more than one fin to the surfboard.

9. The fin module according to claim 8, wherein the core and the base are formed in two separable parts, a fin with a fixing base or tab and a separate fin box.

10. The fin module according to claim 8, further including a boss to receive the connector engagement end.

11. The fin module according to claim 10, wherein the boss is configured to receive an insert, the connector engagement end being engageable within the insert portion in the boss.

12. The fin module according to claim 11, wherein the insert is in the form of a plug forming an internal lining within the boss, the insert made from a softer and/or more resilient material than the fin box and the connector.

13. The fin module according to claim 10, wherein the boss defines a chamber that is substantially cylindrical and includes an internal wall feature that cooperates with a complementary insert feature to prevent rotation of the insert in the boss.

14. The fin module according to claim 13, wherein the insert is separable from the boss chamber and replaceable.

15. The fin module according to claim 8, wherein the fin box includes more than one cavity to receive a plurality of fins.

16. The fin module according to claim 8, wherein more than one fin module may be used on a particular surfboard, to provide a twin, triple or quad fin arrangement.

17. The fin module according to claim 8, wherein the cavity defines a horizontal engaging surface in the fin box.

18. The fin module according to claim 8, wherein the cavity is a central, longitudinally aligned cavity in the form of a channel shaped slot and the fin base portion includes a corresponding mounting edge.

19. A fin module for attaching a fin to a surfboard comprising a top deck, an underside, and a bore extending through a core between the top deck and the underside, the fin module including:

a fin comprising an inner core and an extending base portion made of substantially rigid material and a cover forming a fin blade made of substantially resilient material; and a fin box made of a substantially rigid material and having a cavity for receiving the base portion; wherein:

the fin box is formed separately to the fin and adapted to receive interchangeable fins having a similarly extending base portion construction;

the fin box is adapted to engageably receive an engagement end of a connector having a head anchorable at or near the deck and an elongate member extendable through the surfboard core, the connector operable to pull the fin box toward the connector head to adjustably space the connector head from the fin box; and the fin box has an outer chamfered edge.

* * * * *